US006851574B1

(12) United States Patent
Traynor

(10) Patent No.: US 6,851,574 B1
(45) Date of Patent: Feb. 8, 2005

(54) SPOON

(76) Inventor: Timothy G. Traynor, 20 Mayo St., Apt. G3, Raleigh, NC (US) 27603

( * ) Notice: Subject to any disclaimer, the term of this patent is extended or adjusted under 35 U.S.C. 154(b) by 0 days.

(21) Appl. No.: 10/744,476

(22) Filed: Dec. 23, 2003

(51) Int. Cl.[7] ..... B65D 37/00; A47J 43/28

(52) U.S. Cl. ..... 222/1; 222/210; 222/214; 30/128; 30/324

(58) Field of Search ..... 30/324, 128, 326, 30/123; 222/206, 207, 209, 210, 211, 212, 213, 214, 215, 1

(56) References Cited

U.S. PATENT DOCUMENTS

| | | | | | |
|---|---|---|---|---|---|
| 8,749 | A | * | 2/1852 | Taylor | 30/128 |
| 439,432 | A | * | 10/1890 | Schoch | 30/128 |
| 461,623 | A | * | 10/1891 | Schoch | 222/340 |
| 510,286 | A | | 12/1893 | Osterman | |
| 511,100 | A | * | 12/1893 | Staren | 222/340 |
| 1,010,795 | A | * | 12/1911 | Pfaff | 30/326 |
| 1,921,535 | A | * | 8/1933 | McLean et al. | 30/128 |
| 1,980,477 | A | | 11/1934 | Ertola et al. | |
| 2,249,551 | A | | 7/1941 | Zohe | |
| 2,252,119 | A | * | 8/1941 | Edmonds | 30/123.3 |
| 2,435,805 | A | * | 2/1948 | Tanner | 30/128 |
| D157,842 | S | | 3/1950 | Chinnock | |
| D166,444 | S | | 4/1952 | Carre | |
| 2,610,400 | A | | 9/1952 | Wendling | |
| 2,640,263 | A | | 6/1953 | Dieterich | |
| 2,660,784 | A | | 12/1953 | Greene | |
| 2,698,996 | A | | 1/1955 | Hickerson | |
| 2,794,335 | A | * | 6/1957 | Weems | 30/128 |
| 2,803,059 | A | | 8/1957 | Murdock et al. | |
| 2,824,369 | A | | 2/1958 | Welch | |
| 2,837,822 | A | * | 6/1958 | Wille | 30/125 |
| 2,868,202 | A | | 1/1959 | Dodge | |
| 3,259,132 | A | | 7/1966 | Katter | |
| D248,009 | S | | 5/1978 | Cannon et al. | |
| 4,779,344 | A | | 10/1988 | Panisch | |
| 5,137,183 | A | | 8/1992 | Mikulec et al. | |
| 5,655,303 | A | | 8/1997 | Janczak | |
| 6,071,523 | A | * | 6/2000 | Mehta et al. | 424/400 |
| 6,105,254 | A | | 8/2000 | Crane et al. | |
| 6,347,727 | B1 | * | 2/2002 | Diaz | 222/101 |
| 6,453,562 | B1 | | 9/2002 | Hakim | |
| 6,467,175 | B2 | | 10/2002 | Bohm-Van Diggelen | |
| 6,524,272 | B1 | | 2/2003 | Berry, Sr. | |

* cited by examiner

*Primary Examiner*—Charles Goodman
(74) *Attorney, Agent, or Firm*—Coats & Bennett, P.LLC.

(57) ABSTRACT

A spoon includes a handle and a bowl disposed on one end of a handle. The bowl includes a curved frame and a pliable section or portion secured to the frame, the pliable section being movable between a first position for containing the food and a second position where the bowl is more shallow than when in the first position. An actuating link extends between the handle and the pliable section. The actuating link is movable by an actuator, and the movement of the actuator causes the actuating link to move the pliable section of the bowl. Food contained within the bowl can be displaced or effectively transferred from the bowl into the mouth of an infant or another person in response to the actuator and actuating link being moved.

27 Claims, 5 Drawing Sheets

SPOON

FIELD OF THE INVENTION

The present invention relates to spoons and more particularly to a spoon having a bowl whose configuration may change and which is operative to positively transfer food contained therein to the mouth of a person being fed.

BACKGROUND OF THE INVENTION

It is common to spoon feed an infant with a baby spoon. Usually the baby spoon is inserted into the infant's mouth and the handle is raised upwardly or moved around in the infant's mouth so as to transfer the food from the bowl into the infant's mouth. Often at a very early age it is difficult for the infant to play a positive role in transferring the food from the bowl. Thus, the feeding of an infant can be very time consuming and messy. Further, in addition to infants, the same problem exists with individuals that have facial muscles that are either non-functional or whose function are impaired.

Therefore, there is a need for a spoon having an actuatable bowl for positively delivering food to the mouth of an infant or another person that has difficulty exercising his or her facial muscles.

SUMMARY OF THE INVENTION

The present invention relates to a spoon having a handle and a bowl. A pliable section forms a part of the bowl and is deformable or movable between first and second positions. Extending between the handle and bowl is an actuating link. Connected to the actuating link is an actuator for moving the actuating link and causing the pliable section of the bowl to move between first and second positions.

In one particular embodiment, the actuating link is flexible and flexes back and forth, causing the pliable section of the bowl to move between the first and second positions.

In another embodiment, the actuating link is moved back and forth with respect to the handle and is connected to at least a portion of the pliable section. As the actuating link in this embodiment is moved in one direction, a portion of the actuating link will bow or change configurations and because that portion of the actuating link is connected to the pliable section, the pliable section moves between first and second positions.

In, addition, the present invention entails a method of changing the configuration of a portion of the bowl of a spoon comprising extending an actuating link between a handle of the spoon and the bowl portion of the spoon. An actuating link is moved between first and second positions. As the actuating link is moved between first and second positions, the pliable bowl portion is deformed or its configuration is changed in response to the actuating link being moved.

DESCRIPTION OF EXEMPLARY EMBODIMENT

Figure 1:
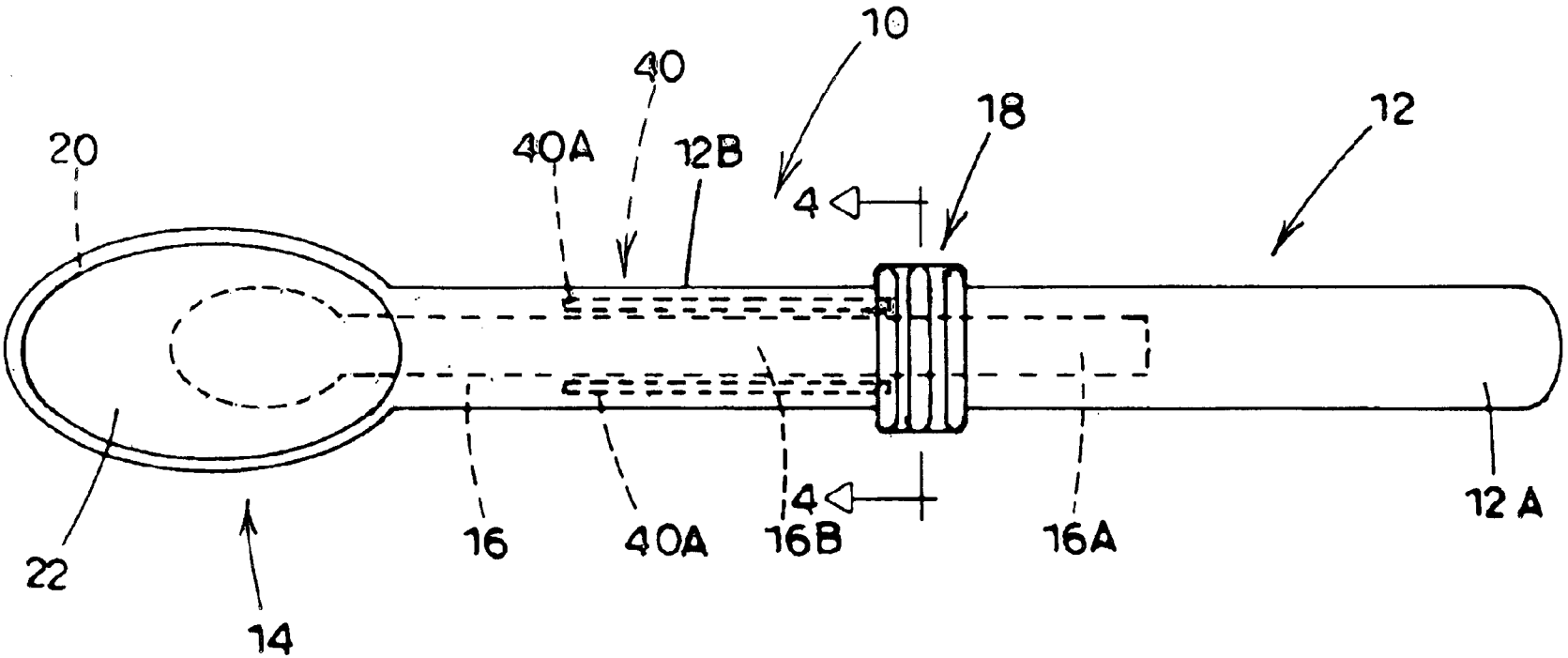
FIG. 1 is a perspective view of a first embodiment for the spoon of the present invention.

With further reference to the drawings, a spoon is shown therein and indicated generally by the numeral 10. As will be appreciated from subsequent portions of this disclosure, spoon 10 is particularly designed to be used in feeding an infant or a person that suffers from facial paralysis. Spoon 10 basically comprises a handle indicated generally by the numeral 12 and a bowl indicated generally by the numeral 14 connected at one end of the handle. An actuating link indicated generally by the numeral 16 extends between the handle 12 and the bowl. More particularly, actuating link 16 is connected to the bowl 14 which is deformable or, expressed in another way, has the ability to change configurations. As the actuating link 16 is moved between two positions, the configuration of the bowl 14 is changed. An actuator 18 is connected to or engages the actuating link. As the actuator 18 is moved between the two positions, the actuating link 16 is also moved and that causes, in turn, the pliable bowl 14 to move or change configurations.

Figure 2:
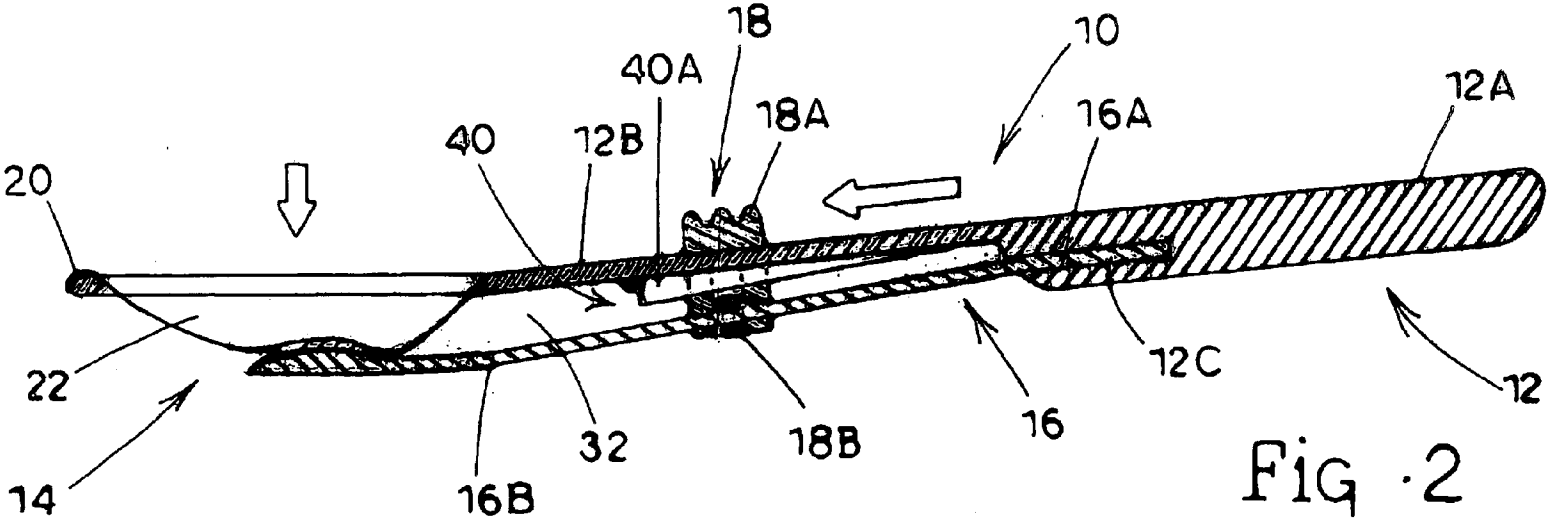
FIG. 2 is a cross sectional view of the spoon of FIG. 1 showing the bowl in a first position.
Figure 3:
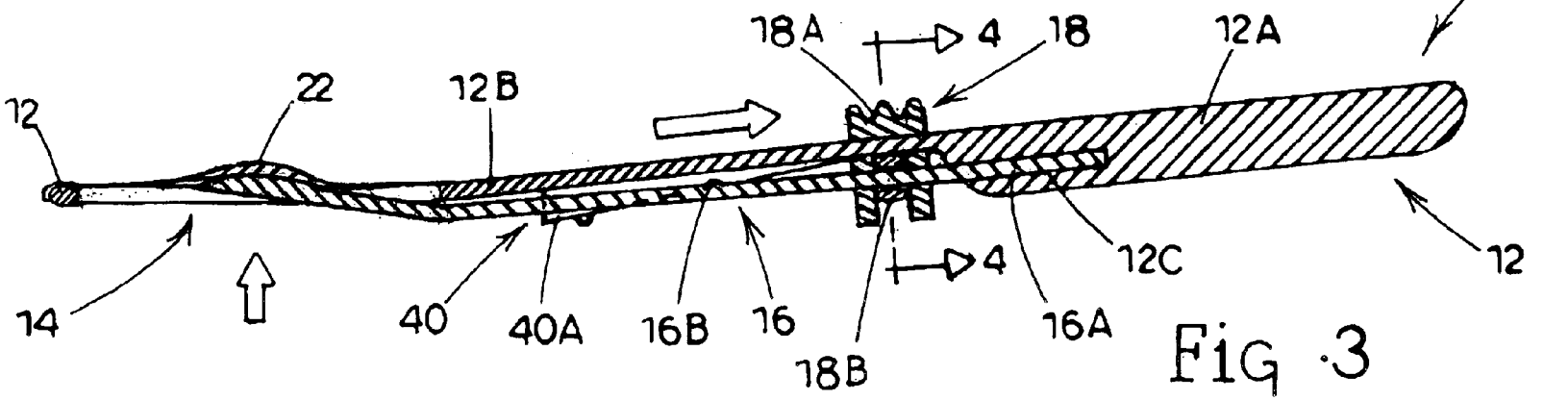
FIG. 3 is a cross sectional view of the spoon of FIG. 1 showing the bowl in a second position.
Figure 4:
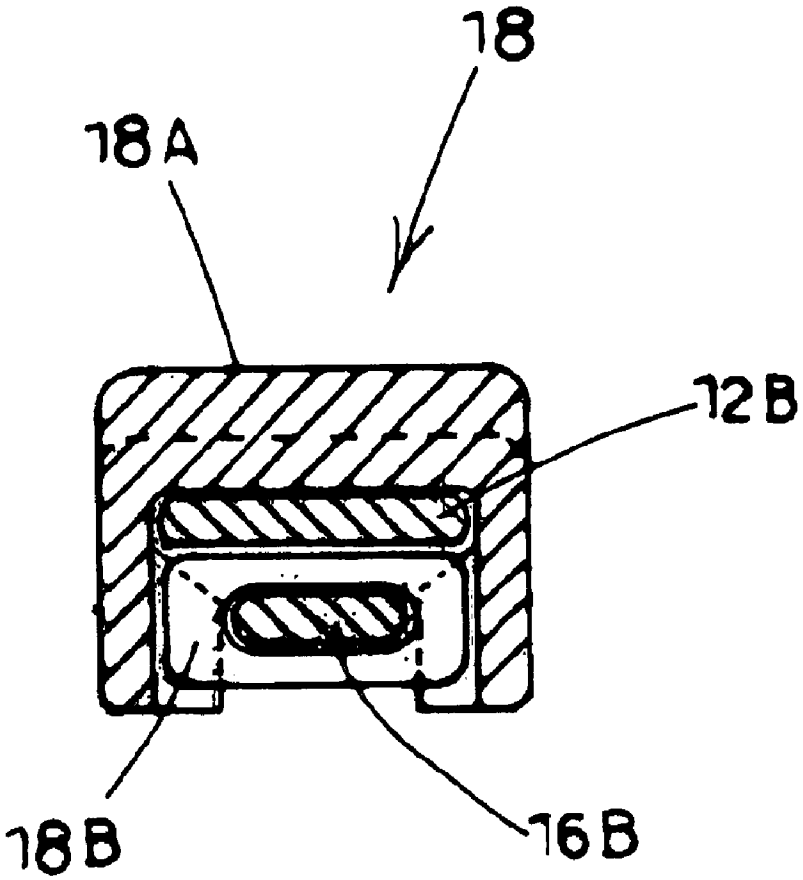
FIG. 4 is a transverse sectional view of the spoon of FIG. 1 taken through the lines 4—4 in FIG. 1.
Figure 5:
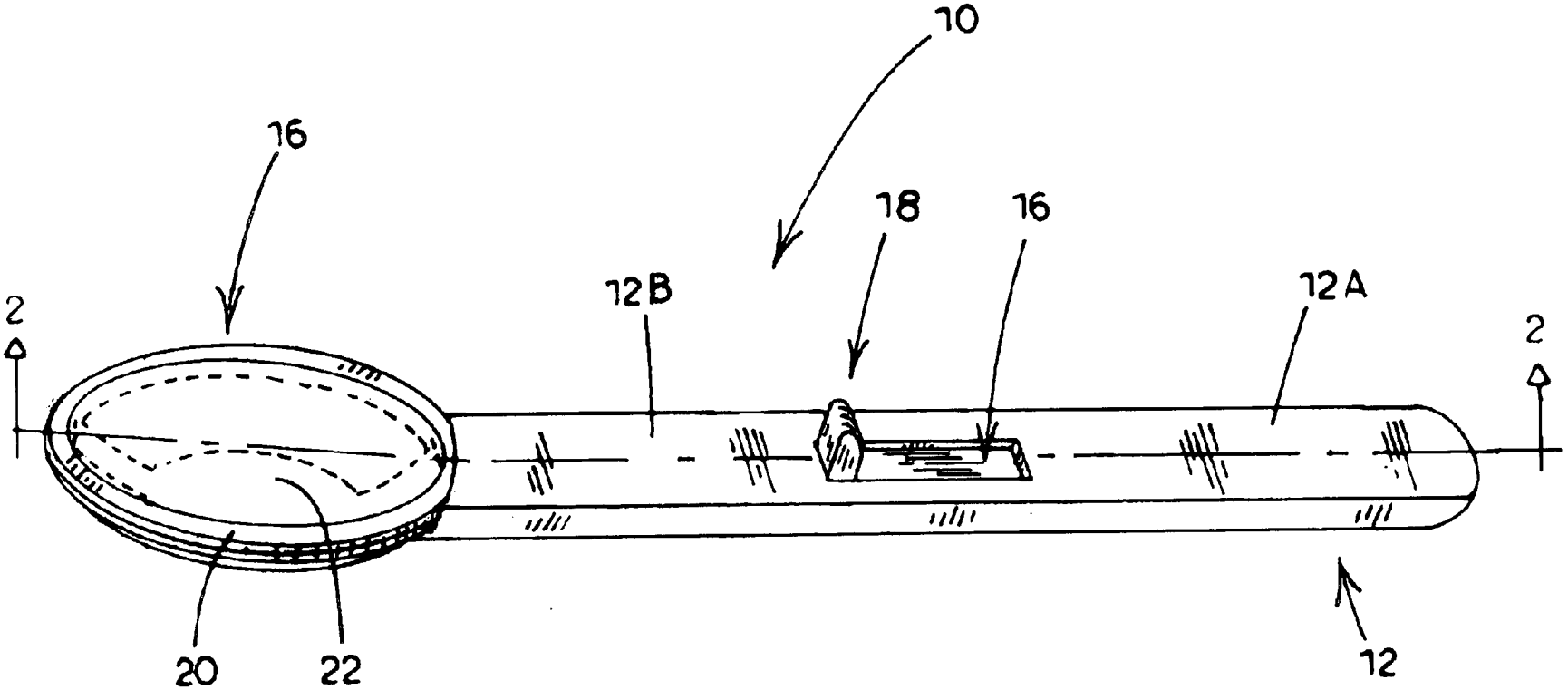
FIG. 5 is a perspective view of a second embodiment of the spoon of the present invention.
Figure 6:
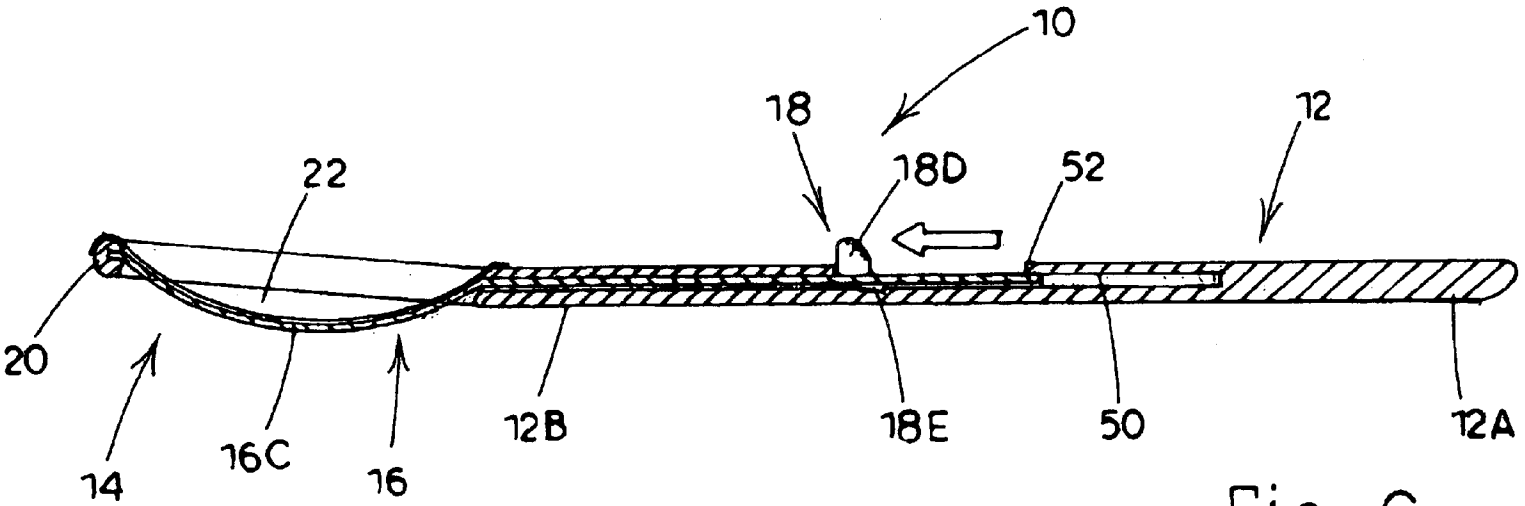
FIG. 6 is a longitudinal sectional view of the spoon of FIG. 5 showing the bowl in a first position.
Figure 7:
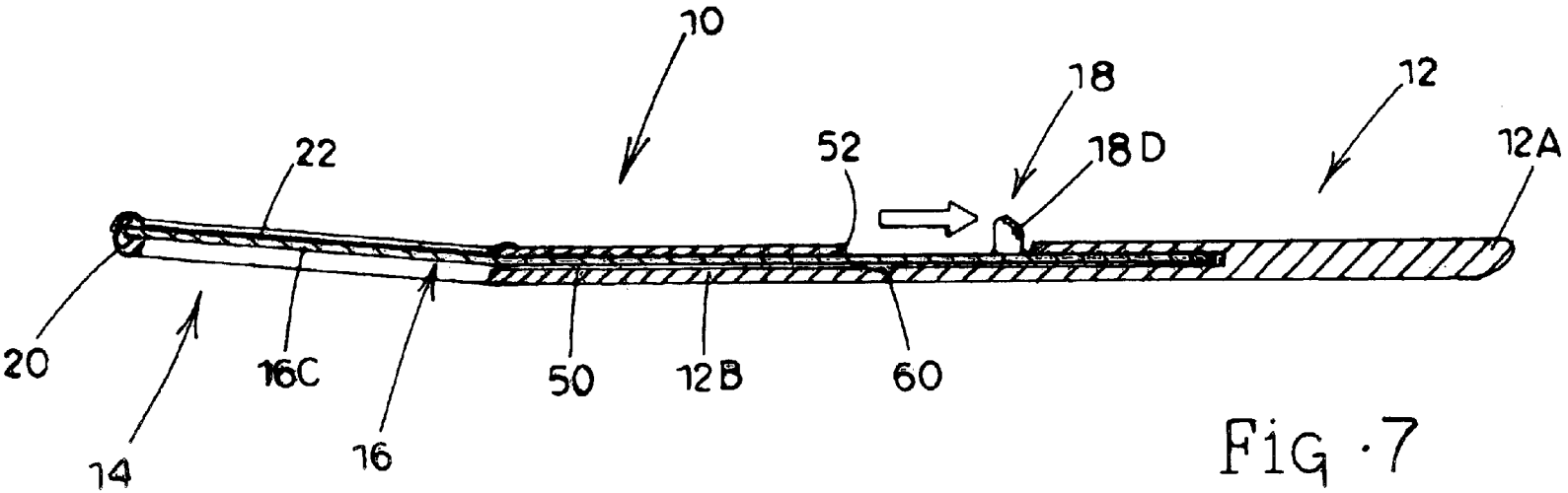
FIG. 7 is a longitudinal sectional view of the spoon of FIG. 5 showing the bowl in a second position.

Herein two embodiments are shown, the embodiment illustrated in FIGS. 1–4 and the design or embodiment shown in FIGS. 5–7. In each case, the bowl 14 includes a frame 20. In the case of the embodiments illustrated herein, frame 20 assumes a generally circular or oval configuration. However, the frame 20 could be any other desirable shape. Forming a part of the bowl 12 is a pliable section indicated by the numeral 22. Pliable section 22 is secured to the frame 20 and extends inwardly therefrom such that in one position the pliable section forms a bowl having a selected depth for holding food or other edible or drinkable products. The pliable section can be made of various materials. In some embodiments the pliable section would comprise a stretchable diaphragm or a pliable membrane or a piece of flexible rubber or other elastic material. In any event, the pliable section 22 is designed such that the same can assume various shapes and configurations. For example, with respect to the first embodiment, FIG. 2 shows the bowl portion in a first position such that the bowl has a depth and is capable of holding food. In another configuration, the pliable section 22 assumes: a generally horizontal or slightly horizontal configuration. This is illustrated in FIG. 3. As will be appreciated from subsequent portions of the disclosure, when the pliable section 22 assumes the position of FIG. 2, the bowl 14 of the spoon 10 is capable of holding food for delivery to a baby's mouth or to the mouth of another person. Once the configuration of the bowl has been altered to that shown in FIG. 3, it is appreciated that food product carried by the bowl will effectively be transferred or delivered from the bowl into the mouth of a baby or person. Therefore, in this disclosure, it is said that the bowl or particularly the pliable section 22 is movable between first and second positions. As will be appreciated from subsequent portions of the disclosure and viewing the drawings, the configuration of the bowl can assume an infinite number of shapes or configurations. However, in the context of this specification, it should be appreciated that the shape of the bowl or pliable section 22 can move or change configurations such that in one position the bowl is capable of holding food and in the other position the bowl has a tendency to discharge food material from the bowl into an infant's or person's mouth.

Turning to a discussion of the handle indicated generally by the numeral 12, the handle includes an end portion 12A and an intermediate portion 12B. Note that end portion 12A forms a terminal end portion of the spoon while the intermediate portion 12B extends generally between the bowl 14 and the end portion 12A of the handle. Formed in the end portion 12A of the handle shown in FIGS. 2–3 is an opening or slot 12C.

Connected to the handle 12 and extending therefrom is the actuating link 16. In the case of the embodiment shown in FIGS. 1–4, the actuating link 16 is formed of a flexible member that can flex back and forth. That is, the actuating link 16 is bendable and can be constructed of plastic, spring steel, wood, metal or other suitable materials. In the case of the first embodiment, the actuating link 16 includes an end portion that is inserted into the opening or slot 12C of the handle 12. From there the actuating link projects towards the bowl 14. The portion extending between the slot 12C and the opposed end is referred to as a flexible portion 16B. Flexible portion 16B is connected to a bottom portion of the pliable section 22. Therefore, as the flexible portion 16B of the actuating link 16 moves up and down as viewed in FIGS. 2–3, it is seen that the shape or configuration of the bowl 14 and particularly the pliable section 22 changes. Note the difference in the configuration of the pliable section 22 in FIG. 2 and the configuration of the pliable section 22 shown in FIG. 3. It should be appreciated that the actuating link 16 could be hinged to handle 12 and in such a case would move back and forth about the hinge. Further, it is contemplated that the actuating link could move back and forth based in part on a hinged type connection and based in part on the actuating link being flexible.

Formed or secured on the underside of the intermediate portion 12B of the handle is a cam structure indicated generally by the numeral 40. Cam structure 40 includes a pair of inclined wedge shaped members 40A that lie underneath the intermediate portion 12B of the handle 12. The inclined wedges 40A include a lower surface. It is appreciated from the drawings, particularly FIGS. 1–3, that the actuating link 16 is of a width such that it can move up and down between the inclined wedges 40A. That is, as viewed in FIGS. 2 and 3, it is seen that the flexible section 16B of the actuating link 16 moves up and down between the wedges 14A. Also, there is an open space 32 defined between the handle 12 and the actuating link 16. As the actuating link 16 flexes back and forth in the first embodiment, it is appreciated that the size of the open space 32 varies.

An actuator 18 is connected to the handle 12. More particularly, the actuator 18 extends at least partially around the top of the intermediate portion 12B of the handle and between the inclined cam wedges 40A and the actuating link 16. Actuator 18 includes a top or thumb engagement piece 18A. Confined within a pair of opposed slots in the sides of the actuator 18 is a slide device 18B. See FIG. 4. Slide device 18B encircles or surrounds the actuating link 16 and particularly the flexing section 16C. As the slide device 18B moves up and down within the actuator 18, it is seen that its position varies with respect to the top 18A of the actuator. Note in FIG. 2, as the actuator moves towards the bowl 14, that the slide device 18B will engage the cam surfaces 14A and move downwardly in the slide slots of the actuator. Effectively, the cam surfaces 40A push the slide device 18B downwardly and that, in turn, flexes or pushes the flexible section 16B of the actuating link 16 downwardly. Thus, since the actuating link 16 is connected to the pliable section 22 of the bowl 14, it follows that the right to left movement of the actuator 18 results in the bowl assuming an open position, that is a position where the bowl has depth and capacity to hold a volume of food material. However, as the actuator 18 is moved left to right as viewed in FIG. 3, it is seen that the actuating link 16 tends to spring back to a normal generally straight position with respect to slot 12C formed of the handle 12. Thus, as the actuating link 16 moves to this neutral or stable position, the flexible portion 16B of the actuating link 16 effectively pushes up and closes the bowl 14 and particularly the pliable section 22, causing the surface to assume more of a horizontal position. This will obviously force or transfer food material from the bowl 14.

The cam surfaces 40A could be provided with one or more stops that would engage a portion of the actuator 18 as the actuator is moved back and forth. This would enable the actuator 18 to be easily stationed or maintained in one or more positions along the cam surfaces 40A. The stops would, of course, be sized or configured such that the actuator 18 could be moved back and forth over them.

Turning to FIGS. 5–7, a second embodiment of the present invention is shown therein. This second embodiment parallels the first embodiment described above in many respects. However, there are some differences. Here the handle 12 includes an elongated slot 50 that is adapted to receive the actuating link 16. The actuating link 16 is movable back and forth with respect to the handle 12. In a preferred design, a portion of the actuating link is confined within the slot 50. Actuating link 16 includes a flexing or bowing section 16C. This flexing section 16C includes a terminal end portion that fits into a slot formed on the inner side of the frame 20 that forms a part of the bowl 14. This is illustrated in FIGS. 6–7. Actuator 18 in this case is secured to the actuating link 16 and extends upwardly through an opening 52 formed in the handle. Actuator 18 in this case assumes the form of a thumb actuator 18D. While thumb actuator 18D is secured to the actuating link 16, it is slightly movable thereon such that in an extended position, as shown in FIG. 6, the thumb actuator 18D can be pivoted downwardly to where a detent 18E, that forms a part of the actuator, can lock into a catch 60 formed in the handle 12. It is appreciated that once the actuating link 16 has been pushed from right to left as viewed in FIG. 6, that the flexible portion 16C of the actuating link 16 will assume a bowed configuration. Again, this is because a terminal end of the actuating link 16 is confined within a slot within the frame 20 of the bowl 14. It should be appreciated that the pliable section 22 is secured to the frame 20 of the bowl and also to the flexible portion 16C of the actuating link 16. This securement can be achieved by glue or heat welding. Note that when the flexible portion 16C of the actuating link 7 of assumes the bowed configuration as show in FIG. 6, this effectively stores energy within the actuating link 16. Thus when the thumb actuator 18D is unlocked from the position shown in FIG. 6, the stored energy will effectively push the actuating link 16 left to right as shown in FIG. 7. At the end of the movement, the flexible portion 16C will assume a generally horizontal configuration with respect to the bowl 14. Note that the pliable section 22, which can be in the form of an elastic diaphragm or membrane, also assumes a generally horizontal configuration.

Like the first embodiment, when the spoon 10 assumes the configuration shown in FIG. 6 the bowl has a depth suitable for holding food material. This enables food to be placed in the bowl. Thereafter the spoon can be inserted into an infant's mouth, for example. To discharge or transfer the food to the infant, the actuator 18D can be released from the lock position shown in FIG. 6 enabling the actuator 18D to move left to right as viewed in FIG. 7. This causes the flexible section 16C to move upwardly and causes the pliable section 22 to move accordingly to its second position wherein in this case the pliable section assumes a generally horizontal attitude. This effectively discharges food from the bowl 14. Now the spoon can be pulled from the baby's mouth and in the process the food originally held in the bowl 14 can be easily transferred to the infant without having to angle and manipulate the spoon at various angles with respect to the infant's mouth such that the food is effectively dumped into the infant's mouth.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of changing the configuration of a pliable bowl portion of a spoon, comprising extending an actuating link between a handle and the bowl portion; moving the actuating link between first and second positions; and moving the pliable bowl portion in response to the actuating link being moved between the first and second positions.

2. The method of claim 1 including moving the actuating link between first and second positions causing a portion of the actuating link to bow.

3. The method of claim 2 wherein a portion of the actuating link is secured to the bowl and wherein when the portion of the actuating link is bowed the pliable bowl portion conforms, at least partially, to the bowed portion of the actuating link.

4. The method of claim 3 including moving an actuator relative to the handle and engaging the actuating link and flexing the actuating link as the actuator is moved relative to the handle.

5. The method of claim 4 wherein the engagement of a portion of the actuator with the actuating link causes the actuating link to be flexed.

6. The method of claim 1 including flexing the actuating link back and forth and causing the pliable bowl portion to change configurations.

7. The method of claim 1 including moving the actuator relative to the handle and as the actuator is moved engaging a cam surface with the actuator wherein a portion of the actuator is moved by the cam surface into engagement with the actuating link which results in the actuating link being moved.

8. A spoon comprising:

a. a handle;

b. a bowl;

c. the bowl including a pliable section that is movable between first and second positions;

d. a movable actuating link extending between the handle and the bowl; and e. an actuator for moving the actuating link and moving the pliable section of the bowl between the first and second positions.

9. The spoon of claim 8 wherein the actuating link is flexible and flexes when the actuating link is moved by the actuator.

10. The spoon of claim 8 wherein the actuating link includes first and second end portions, the first end portion being secured to the handle and the second end portion being movable and connected to the pliable section of the bowl.

11. The spoon of claim 10 wherein the first end portion of the actuating link is enclosed within an opening in the handle.

12. The spoon of claim 8 wherein the actuating link includes a segment that is spaced from the handle such that an open area is defined between the actuating link and the handle.

13. The spoon of claim 12 wherein the actuator includes a portion that moves through the open space defined between the handle and actuating link.

14. The spoon of claim 13 including a cam surface spaced from the actuating link and engaged by the actuator as the actuator moves.

15. The spoon of claim 14 wherein the cam surface extends from the handle and is disposed adjacent the actuating link and wherein the actuator includes a portion that extends between the cam surface and the actuating link and wherein movement of the actuator causes the distance between the cam surface and the actuating link to vary.

16. The spoon of claim 8 where the actuating link includes one end portion fixed with respect to the handle and wherein the actuating link is flexible and flexes back and forth in response to the pliable section of the bowl moving between the first and second positions.

17. The spoon of claim 8 wherein the actuating link includes an end portion that connects directly to the pliable section of the bowl.

18. The spoon of claim 8 wherein the actuating link moves back and forth with respect to the handle.

19. The spoon of claim 8 wherein the handle includes a slot and the actuating link slides back and forth in the slot.

20. The spoon of claim 8 wherein a portion of the actuating link assumes at least two configurations, a bowed configuration and a non-bowed configuration.

21. The spoon of claim 8 wherein the actuating link includes an end portion that extends under the pliable section of the bowl.

22. The spoon of claim 21 wherein the end portion of the actuating link is secured to a frame structure that forms a part of the bowl.

23. The spoon of claim 22 wherein the bowl includes a frame and wherein the end portion of the actuating link is connected to the frame.

24. The spoon of claim 8 wherein the actuator extends from the actuating link.

25. The spoon of claim 24 wherein the handle includes a slot for receiving the actuating link and wherein the actuator extends upwardly from the actuating link through an opening formed in the handle, and wherein the actuator can move back and forth in the opening of the handle.

26. The spoon of claim 8 wherein the actuating link includes a flexible portion disposed below the pliable section and wherein in one position the flexible portion assumes a bowed configuration.

27. The spoon of claim 26 wherein the flexible portion of the actuating link is secured to a frame that forms a part of the bowl and is also secured to the pliable section such that as the flexible portion of the actuating link is bowed, the pliable section of the bowl tends to move with the adjacent portion of the actuating link.

* * * * *